US006323849B1

(12) United States Patent
He et al.

(10) Patent No.: US 6,323,849 B1
(45) Date of Patent: Nov. 27, 2001

(54) DISPLAY MODULE WITH REDUCED POWER CONSUMPTION

(75) Inventors: Fan He, Grayslake; Chris Grivas, Crystal Lake, both of IL (US); Phillip L. Roccapriore, Ft. Lauderdale, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/236,119

(22) Filed: Jan. 22, 1999

(51) Int. Cl.[7] ..... G09G 5/00
(52) U.S. Cl. ..... 345/204
(58) Field of Search ..... 345/204, 211, 345/98, 100, 87, 214

(56) References Cited

U.S. PATENT DOCUMENTS

| | | | | |
|---|---|---|---|---|
| 4,570,115 | | 2/1986 | Misawa et al. . | |
| 4,823,121 | | 4/1989 | Sakamoto et al. . | |
| 5,167,024 | | 11/1992 | Smith et al. . | |
| 5,426,446 | * | 6/1995 | Takei et al. | 345/82 |
| 5,710,576 | | 1/1998 | Nishiyama et al. . | |
| 5,739,887 | * | 4/1998 | Ueda et al. | 349/149 |
| 5,748,165 | * | 5/1998 | Kubota et al. | 345/96 |

FOREIGN PATENT DOCUMENTS

| | | |
|---|---|---|
| 0 474 231 B1 | 12/1996 | (EP) . |
| 0 811 866 A1 | 12/1997 | (EP) . |

OTHER PUBLICATIONS

Linear Technology, Aug. 1997, Dual and Quad Micropower Rail–to–Rail Input and Output Op Amps, pp. 1–12.

* cited by examiner

*Primary Examiner*—Richard Hjerpe
*Assistant Examiner*—Ronald Laneau
(74) *Attorney, Agent, or Firm*—Sylvia Y. Chen; Roland K. Bowler II

(57) ABSTRACT

A display module (100) with reduced power consumption uses a control circuit (110) to reset row and column display drivers (130, 140) and turn off a portion of the display (150) when the display module (100) is in a partial display mode. The partial display mode allows a reduction in the driving voltages for the display which in turn reduces the power needed by the bias voltage divider (120) which produces the driving voltages. The display module (100) with reduced power consumption is applicable to both LCD and non-LCD technologies, such as electroluminescence or cathode ray tube, using a multiplex or scanning methodology.

20 Claims, 3 Drawing Sheets

DISPLAY MODULE WITH REDUCED POWER CONSUMPTION

FIELD OF THE INVENTION

This invention relates generally to displays, and more particularly to high-resolution liquid crystal displays (LCDs) for portable electronic devices,

BACKGROUND OF THE INVENTION

For many electronic devices, the display is a major source of power drain. For a liquid crystal display (LCD), the number of row lines in the LCD determines the value of the bias voltage, and hence the driving voltages, needed to operate the display. As displays get larger, the number of row lines increases, the bias voltage requirement gets larger, and the power consumption of the bias voltage divider, which uses the bias voltage to provide driving voltages for the LCD, increases.

The power used to turn on and off pixels in an LCD display module is proportional to the square root of the number of row lines in the LCD. In other words, the power consumption of an LCD module is proportional to the row-resolution of the display. Thus, even when only part of the display is used to convey information, a large display uses almost the same amount of power as if the entire display was conveying information. For portable electronic products, such as cellular telephones, personal digital assistants, palm-sized computers, and electronic games, increasing power consumption caused by larger and higher-resolution displays results in decreased battery life.

Thus, there is a need to reduce the power consumption of a display module while maintaining a desired resolution and size but without significantly degrading the display's performance and also without substantially increasing production costs for the display module.

DETAILED DESCRIPTION OF THE PREFERRED EMBODIMENT

The power used by a liquid crystal display (LCD) module depends on the power consumption of the liquid crystal material, the power consumption of the display drivers, and power consumption of the bias voltage divider. A display module with reduced power consumption uses a control circuit to control the drivers and turn off a portion of the display when it does not show useful information, which in turn allows a reduction in the power used by the bias voltage divider when the display is in a partial display mode. The display module with reduced power consumption is applicable to both LCD and non-LCD technologies, such as electroluminescence or cathode ray tube, using a multiplex or scanning methodology.

Figure 1:
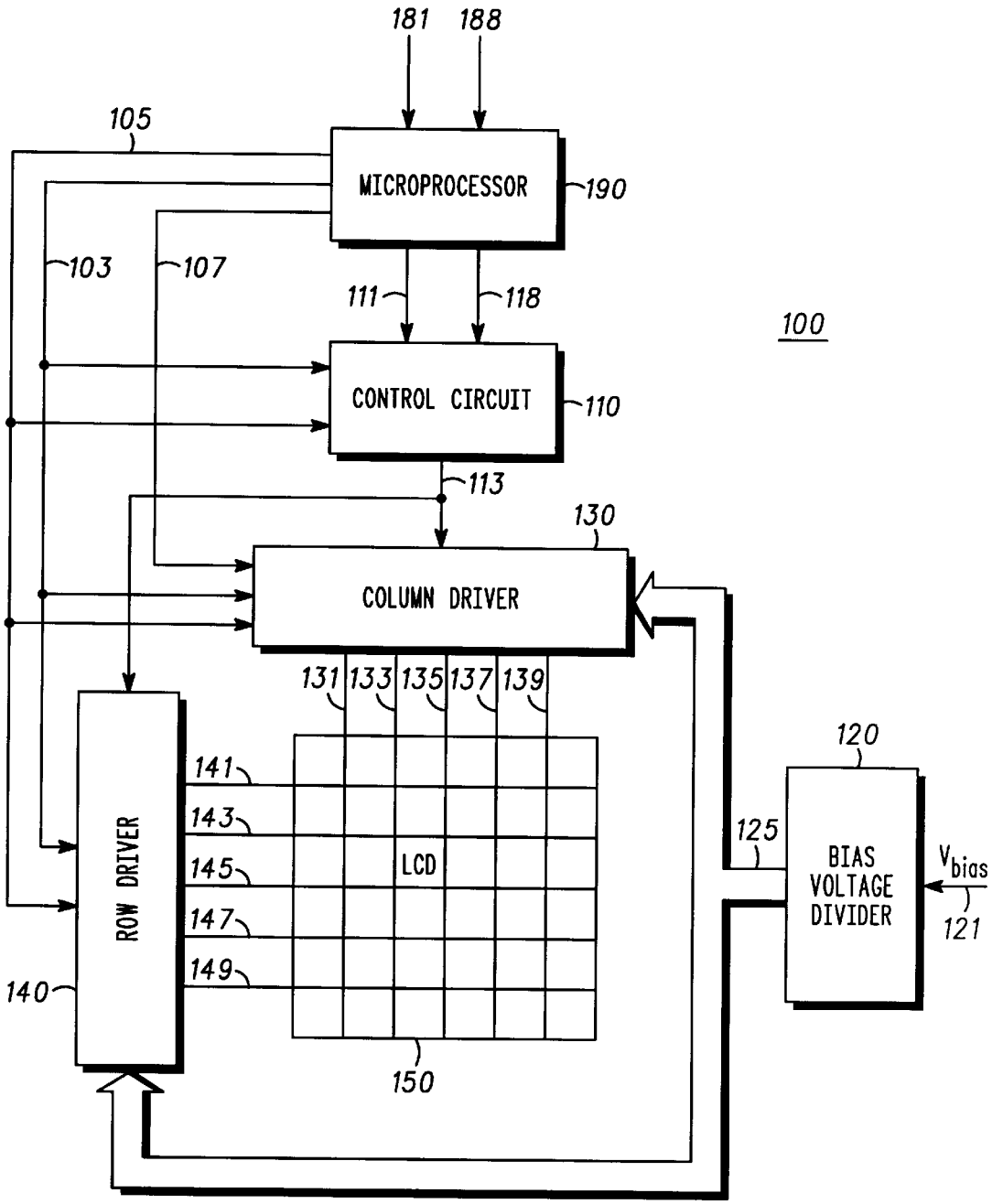
FIG. 1 shows a block diagram of a display module with reduced power consumption according to the preferred embodiment.

FIG. 1 shows a block diagram of a display module 100 with reduced power consumption implemented in a radiotelephone according to the preferred embodiment. In this preferred embodiment, the display module 100 includes a control circuit 110 which controls a column driver 130 and a row driver 140 via a reset line 113. The control circuit 110 receives partial display control signals, such as one-eighth display and one-quarter display control signals, on one-eighth control line 111 and one-quarter control line 118. These partial display control signals are generated by the microprocessor 190 based on signals on control lines 181, 188. The control lines 181, 188 can be activated by a physical condition (for example, a cover of the radiotele-phone is closed such that it covers the bottom seven-eighths of the display) or an electrical state (for example, the radiotele-phone is in standby mode and only one-quarter of the display is needed, or the user has not pressed a keypad button for a predetermined amount of time) Additionally, partial display control signals can be activated based on the amount of data to be displayed as determined by the microprocessor 190. Of course different fractions of the display can be selected for turn-off depending on the particular device and application using the display module 100, and there can be more or less than two partial display modes. The control circuit 110 will be explained in more detail with reference to FIG. 2 and FIG. 3.

In accordance with standard LCD driving techniques, a microprocessor 190 sends frame control signal pulses on a frame control line 103 and line control signal pulses on a line control line 105 to the column driver 130 and the row driver 140. The frame control signal is used to vary driving voltages from the bias voltage divider on bus 125 to protect the liquid crystals from direct current components of the driving voltages The line control signals are used to shift data from one line to the next. The microprocessor 190 also sends display data to the column driver 130 via a data line 107. The column driver 130 and the row driver 140 control column lines 131, 133, 135, 137, 139 and row lines 141, 143, 145, 147, 149 in the liquid crystal display 150 to turn on and turn off pixels of the display. This driving technique progressively activates lines of the display in a multiplex or scanning fashion.

The frame control signals and the line control signals are also sent to the control circuit 110. When the column and row drivers are reset due to a low (logic zero) reset signal on line 113 from the control circuit 110, the shift registers of the drivers 130, 140 will be reset. The system clock frequency and the frame refresh rate of the display are unaffected by the reset signal.

When the LCD module 100 is in a partial display mode, the microprocessor 190 can reduce the line pulse frequency of the line control signal while maintaining the same frame refresh rate. Because the charge on a pixel in the liquid crystal display 150 is equal to the voltage multiplied by the time period the voltage is applied, a lower line pulse frequency allows for a longer time period, and a lower voltage can be used to produce the same amount of charge. Thus, when the LCD module 100 is in a partial display mode, the drivers 130, 140 can use a lower bias voltage and lower driving voltages. Because the power consumption of the bias voltage divider 120 is proportional to the square of the bias voltage on line 121, the power consumption of the display is significantly lower when in a partial display mode.

A liquid crystal display 150 having only five column lines and five row lines is shown for explanation purposes only. The control circuit 110 and bias voltage divider 120 should be used in conjunction with a large LCD for significant power savings, and a large LCD commonly has over 250 column lines and 150 row lines. Also, in practice large LCDs usually implement a row or column driver such as drivers 130, 140 with several cascaded drivers, because there are too many lines in the display for a single driver to handle. The fraction of a display that can be turned off using the control circuit 110, however, does not need to have any relationship to the number of lines controlled by a single one of the several cascaded drivers. In other words, if a single cascaded driver controls fifty lines, the control circuit 110 is not limited to resetting the drivers after fifty or one-hundred lines; it can reset the drivers after only seventeen lines, for example.

Figure 2:
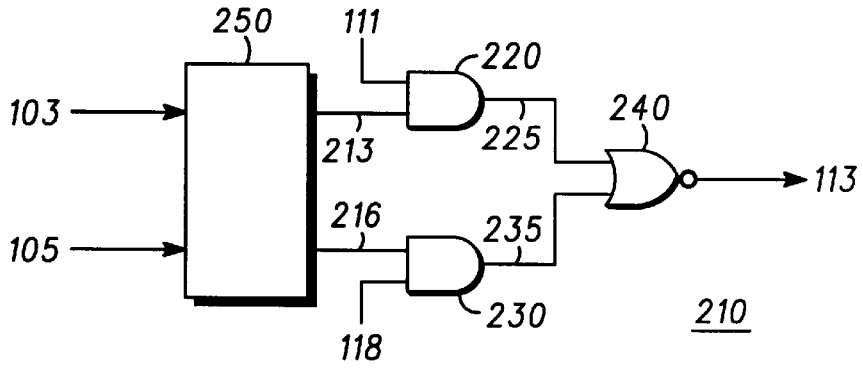
FIG. 2 shows a circuit diagram of the control circuit shown in FIG. 1 according to a first embodiment

FIG. 2 shows a circuit diagram of the control circuit 110 shown in FIG. 1 according to a first embodiment. The control circuit turns off unused portions of the display to show fewer lines of information to a user. The sample partial display modes described herein will be a partial display mode activating only the top eighth of the display and a partial display mode activating only the top quarter of the display. Note that these partial display modes need not be related to the number of lines controlled by a single one of several cascaded display drivers.

The microprocessor 190 shown in FIG. 1 sends frame and line control signals to control circuit 210 using frame control line 103 and line control line 105. An integrated circuit 250 that is essentially a modulo counter creates high (logic one) control signals on line 213 and line 216 when the available partial display fractional amounts have been displayed. In this embodiment, when one-eighth of the lines in the display have been activated, line 213 goes high; when one-quarter of the lines in the display have been activated, line 216 goes high.

If only the top eighth of the display will be turned on, one-eighth control line 111 is pulled high (logic one) and the other control line 118 remains low (logic zero). If the top quarter of the display will be turned on, control line 118 is pulled high (logic one) while control line 111 remains low (logic zero). When the full display is active, both control lines 111, 118 are pulled low (logic zero). Using AND logic gates 220, 230 connected using lines 225, 235 to the inputs of an XOR logic gate 240, a reset signal is created on reset line 113 based on the number of lines that have already been activated and the partial display control signals. When the reset line 113 goes low, the shift registers of the row and column drivers 130, 140 shown in FIG. 1 are cleared of data. By resetting the row and column drivers before the full display has been activated, part of the display is turned off and power consumption is reduced.

Thus, for example if only one-eighth of the display will be used, the display will reset after only one-eighth of the lines in the display have been activated. The microprocessor 190 shown in FIG. 1 will format the data to fit onto one-eighth of the display, and the display drivers will only drive one-eighth of the display. The power consumption of the display module in the one-eighth display mode will be very close to a smaller display having a size equivalent to the driven one-eighth of the large display. Driving less than the entire display uses less battery power, allows the use of a lower bias voltage and driving voltages, and increases the battery life of the portable electronic device.

The conceptual partitioning of a large display into a one-eighth mode and a one-quarter mode has been described for explanatory purposes only. Different fractions of the LCD can easily be displayed by modifying the counter and logic gates. Note that because the power consumption of an LCD is proportional only to the number of row lines in a display (and not the number of column lines), power savings is achieved mainly through row line reductions. If desired, the microprocessor can be programmed to reduce the driven width of the display, but little power savings is achieved by merely decreasing the width.

Figure 3:
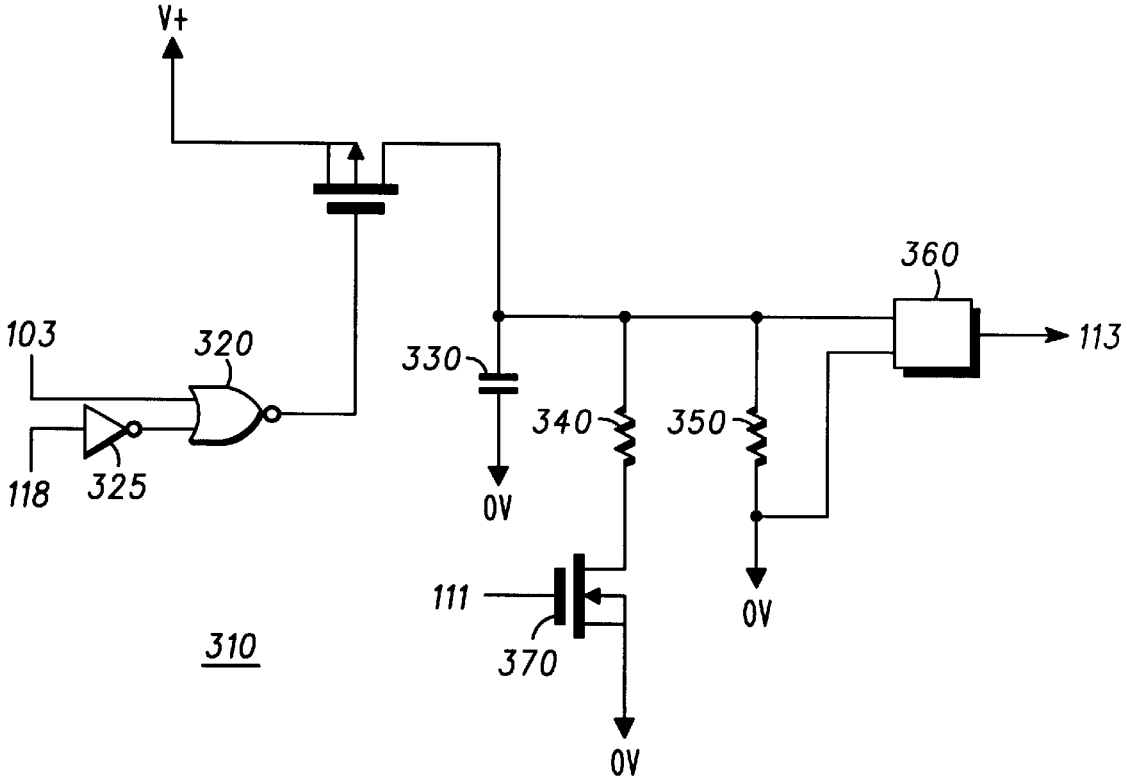
FIG. 3 shows a circuit diagram of the control circuit shown in FIG. 1 according to a second embodiment.

FIG. 3 shows a circuit diagram of the control circuit 110 shown in FIG. 1 according to a second embodiment. Instead of using an integrated circuit and digital logic, this embodiment is an analog control circuit 310 that controls the reset line 113 based on an elapsed time that represents the amount of time needed to power the top one-eighth or one-quarter of the display.

If only the top quarter of the display contains useful information, the one-quarter display line 118 is pulled high (logic one) and the one-eighth control line 111 is low (logic zero). The inverter 325 and XOR logic gate 320 are used to charge a capacitor 330 when a frame control signal on line 103 goes high. The capacitor 330 and a resistor 350 are set so that the time it takes to discharge the capacitor 330 is equivalent to the time it takes to keep the row and column drivers 130, 140 shown in FIG. 1 active for the top quarter of the display. A voltage detector 360 forces the reset line 113 low (logic zero) when the capacitor 330 has decayed below a minimum threshold.

If only the top eighth of the display contains useful information, the one-eighth control line 111 is pulled high (logic one) and the one-quarter control line 118 is also high (logic one). The charging of the capacitor 330 occurs as described above. When discharging the capacitor 330, the logic one on control line 111 turns on the transistor 370 and allows the capacitor 330 to discharge through both resistors 340, 350. If both resistors have the same value, the capacitor discharges twice as fast and only one-eighth of the display is activated before the reset line 113 is forced low by the voltage detector 360. If the one-quarter and one-eighth control lines 111, 118 are low, the display is in full display mode.

Thus, this control circuit 310 is essentially a one-state timer that controls the reset line 113 based on the time elapsed since the frame control line 103 first went high based on the control voltages on the one-eighth control line 111 and the one-quarter control line 118. By driving less than the full display, the display can use a lower bias voltage and driving voltages, and the power consumption of the portable electronic device is reduced.

Figure 4:
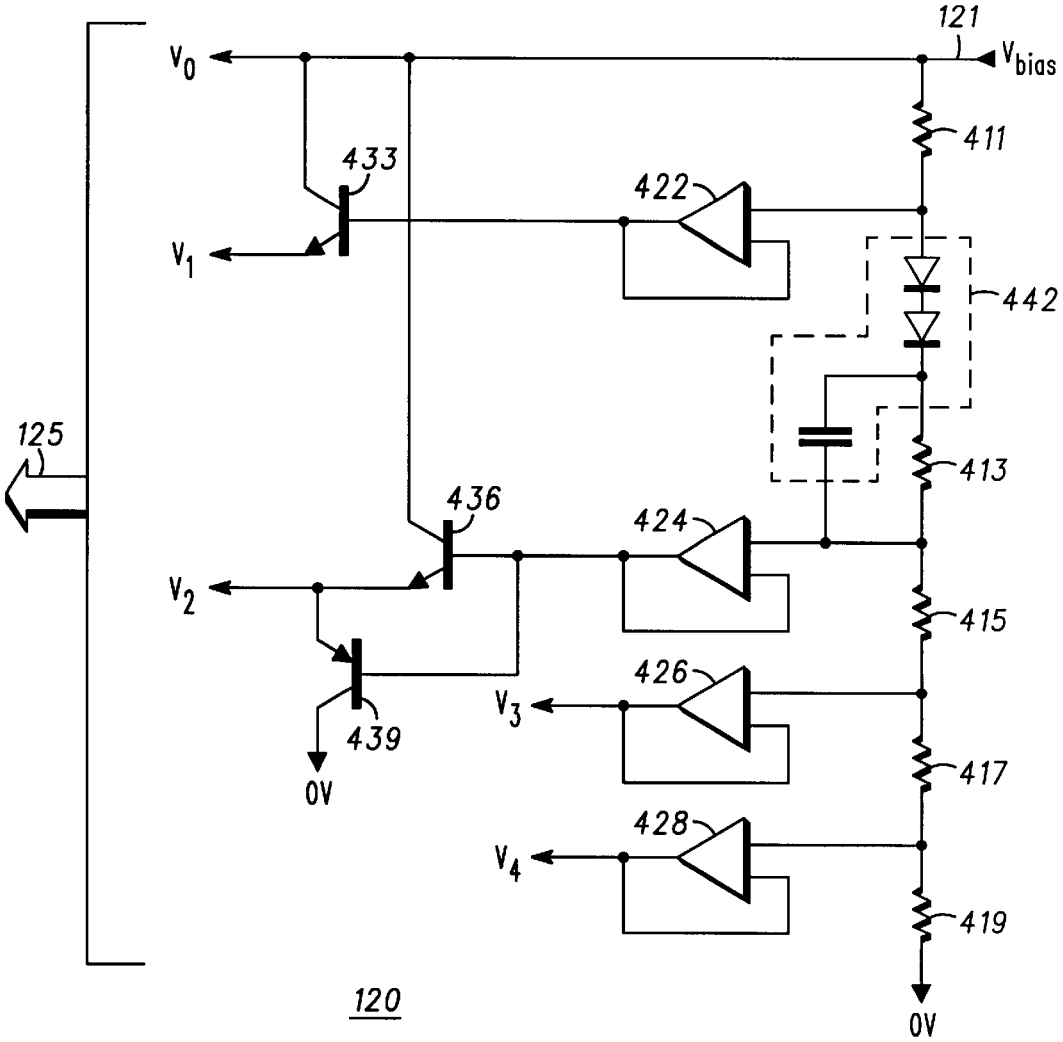
FIG. 4 shows a circuit diagram of the bias voltage divider shown in FIG. 1 according to the preferred embodiment

FIG. 4 shows a circuit diagram of the bias voltage divider 120 shown in FIG. 1 according to the preferred embodiment. The bias voltage $V_{bias}$ to the bias voltage divider 120 varies depending on whether the display is in full display mode, one-quarter display mode, or one-eighth display mode. The voltage $V_{bias}$ from line 121 is divided using resistors 411, 413, 415, 417, and 419 into five voltages $V_0$, $V_1$ $V_2$, $V_3$, and $V_4$, on bus 125 which are used as the driving voltages on each pixel in the LCD to prevent physical deterioration of the liquid crystal material. The bias voltage divider 120 uses micro-power amplifiers 422, 424, 426, 428 rather than general purpose amplifiers as voltage followers to reduce the power consumption of the bias voltage divider 120. Because of the capacitive load of the liquid crystal material, the micro-power amplifiers 422, 424, 426, 428 may experience a current surge for a short period of time during a turn-off of a pixel. A current surge may cause the low frequency micro-power amplifiers to oscillate undesirably due to their smaller gain bandwidth.

To eliminate any opportunity for oscillation and further reduce power consumption, the micro-power amplifiers 422, 424, 426, 428 should be isolated from the display drivers 130, 140 shown in FIG. 1. In the preferred embodiment, three bipolar transistor followers 433, 436, 439 are used to reduce two micro-power amplifiers' output currents at the moment when a pixel is switched from an ON to an OFF state. A bipolar transistor follower has the advantages of having minimal power consumption; however, other types of buffers can be used to isolate micro-power amplifiers from the display driver. A compensation circuit 442 using two diodes and a capacitor is inserted into the resistor ladder to compensate for the voltage drop inherent in the bipolar transistor followers 433, 436, 439. The other voltages $V_3$ and $V_4$ may also be buffered; however, due to their lower voltage values, the associated micro-power amplifiers 426, 428 are much less likely to oscillate.

Thus, the display module with reduced power consumption provides a low power consumption alternative to driving an entire display when only part of the display is needed to provide information to a user. While specific components and functions of the display module with reduced power consumption are described above, fewer or additional components or functions could be employed by one skilled in the art within the true spirit and scope of the present invention. The invention should be limited only by the appended claims.

We claim:

1. A liquid crystal display module comprising:

a microprocessor having a line control signal output, a frame control signal output, and a partial display control signal output;

a control circuit having a display driver reset signal output, the control circuit coupled to the partial display control signal output, the line control signal output, and the frame control signal output of the microprocessor;

a row display driver coupled to the line control signal output and the frame control signal output of the microprocessor, the row display driver coupled to the display driver reset signal output of the control circuit;

a column display driver coupled to the microprocessor;

a liquid crystal display coupled to the row display driver and the column display driver; and a bias voltage divider coupled to the row display driver and the column display driver.

2. A display module according to claim 1, the control circuit comprises a counter circuit having inputs coupled to the partial display control signal output, the line control signal output and the frame control signal output of the microprocessor, an output of the counter circuit is the display driver reset signal output.

3. A display module according to claim 1, the control circuit comprises a timer circuit having inputs coupled to the partial display control signal output, the line control signal output and the frame control signal output of the microprocessor, an output of the timer circuit is the display driver reset signal output.

4. A display module according to claim 1, the bias voltage divider comprises a plurality of voltage outputs formed by a voltage divider network having a bias voltage input, a micro-power amplifier disposed between each of the voltage outputs and the bias voltage input, a buffer coupled to an output of at least some of the micro-power amplifiers.

5. A display module according to claim 4, each buffer comprises a bipolar transistor follower.

6. A display module according to claim 4, a voltage compensation circuit disposed between first and second voltage outputs, the voltage compensation circuit disposed between inputs of the corresponding first and second micro-power amplifiers and the bias voltage input.

7. A radiotelephone comprising:

a microprocessor having a line control signal output, a frame control signal output, and a partial display control signal output;

a control circuit having a display driver reset signal output, the control circuit coupled to the partial display control signal output, the line control signal output, and the frame control signal output of the microprocessor a row display driver coupled to the line control signal output and the frame control signal output of the microprocessor, the row display driver coupled to the display driver reset signal output of the control circuit;

a column display driver coupled to the microprocessor;

a liquid crystal display coupled to the row display driver and the column display driver; and a bias voltage divider coupled to the row display driver and the column display driver.

8. A radiotelephone according to claim 7, the control circuit comprises a counter circuit having inputs coupled to the partial display control signal output, the line control signal output and the frame control signal output of the microprocessor.

9. A radiotelephone according to claim 7, the control circuit comprises a timer circuit having inputs coupled to the partial display control signal output, the line control signal output and the frame control signal output of the microprocessor.

10. A radiotelephone according to claim 7, a bias voltage divider coupled to the row display driver and the column display driver, the bias voltage divider comprises a plurality of voltage outputs formed by a voltage divider network having a bias voltage input, a micro-power amplifier disposed between each of the voltage outputs and the bias voltage input, a buffer coupled to an output of at least some of the micro-power amplifiers.

11. A method for operating a radiotelephone having a display driven by a column display driver and a row display driver in a partial display mode, the method comprising:

generating a partial display control signal by detecting a condition of the radiotelephone in which it is desirable to display a predetermined partial portion of the display;

generating a display driver reset signal dependent on the partial display control signal by determining when the predetermined partial portion of the display has been activated with a bias voltage; and resetting the row display driver after the predetermined partial portion of the display has been activated by communicating the display driver reset signal to the row driver.

12. A method according to claim 11, determining when the predetermined partial portion of the display has been activated by counting a predetermined number of line control signal pulses.

13. A method according to claim 11, determining when the predetermined partial portion of the display has been activated by operating a timer circuit.

14. A method according to claim 11, varying a line control signal pulse frequency based on the partial display control signal.

15. A method according to claim 11, generating the partial display control signal based on whether the radiotelephone is in a standby mode.

16. A method according to claim 11, generating the partial display control signal based on whether a predetermined amount of time has elapsed since a key of the radiotelephone was activated.

17. A method according to claim 11, generating the partial display control signal based on a physical condition of the radiotelephone.

18. A method according to claim 11, generating the partial display control signal based on whether a keypad cover is covering a keypad of the radiotelephone.

19. A method according to claim 11, generating the display driver reset signal by counting a predetermined number of lines of the display activated by the row display driver.

20. A method according to claim 11, generating the display driver reset signal by timing a predetermined elapsed time period corresponding at least approximately to a predetermined number of lines of the display activated by the row display driver.

* * * * *